US009598980B2

(12) United States Patent
Bannon et al.

(10) Patent No.: US 9,598,980 B2
(45) Date of Patent: Mar. 21, 2017

(54) TURBINE LOCK PLUNGER FOR RAM AIR TURBINE ASSEMBLY

(75) Inventors: David G. Bannon, Rockford, IL (US); David E. Russ, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1364 days.

(21) Appl. No.: 13/457,584

(22) Filed: Apr. 27, 2012

(65) Prior Publication Data

US 2013/0287569 A1 Oct. 31, 2013

(51) Int. Cl.
*F01D 25/28* (2006.01)

(52) U.S. Cl.
CPC ..... *F01D 25/28* (2013.01); *F05D 2220/34* (2013.01); *Y10T 29/4932* (2015.01)

(58) Field of Classification Search
CPC ..... F01D 21/00; F01D 21/006; F01D 25/00; B64C 11/00; B64C 11/303; B64D 41/007
USPC ..... 416/44, 46
See application file for complete search history.

(56) References Cited

U.S. PATENT DOCUMENTS 2,955,656 A * 10/1960 Balje et al. ..... 416/137
4,411,596 A * 10/1983 Chilman ..... B64D 41/007 416/137
5,123,614 A 6/1992 Whitehouse
5,562,417 A 10/1996 Grimm et al.
6,127,758 A 10/2000 Murry et al.
6,676,379 B2 * 1/2004 Eccles ..... 416/170 R
7,077,631 B2 7/2006 Eccles et al.
7,296,970 B2 11/2007 Bannon et al.
7,419,357 B2 9/2008 Nohr et al.
7,708,527 B2 5/2010 Eccles et al.
8,066,481 B2 11/2011 Bannon
2010/0158698 A1 6/2010 Russ et al.
2011/0229309 A1 9/2011 Russ

OTHER PUBLICATIONS

U.S. Appl. No. 13/430,890, filed Mar. 27, 2012.
U.S. Appl. No. 13/431,057, filed Mar. 27, 2012.

* cited by examiner

*Primary Examiner* — Gregory Anderson
*Assistant Examiner* — Michael Sehn
(74) *Attorney, Agent, or Firm* — Carlson, Gaskey & Olds, PC

(57) ABSTRACT

A ram air turbine assembly includes a governor shaft rotatable about an axis and a stop shaft coupled for rotation with the governor shaft. A rotatable housing portion surrounds at least a portion of the stop shaft. A lock plunger extends through an opening in the rotatable housing portion to prevent rotation of the rotatable housing portion and minimize vibration impact loading when stowed.

18 Claims, 5 Drawing Sheets

TURBINE LOCK PLUNGER FOR RAM AIR TURBINE ASSEMBLY

BACKGROUND OF THE INVENTION

This disclosure relates to a ram air turbine assembly that includes a lock plunger that prevents the turbine from rotating when stowed, as well as reducing the axial play of various turbine components when stowed.

A typical ram air turbine assembly includes a turbine supported by a support structure that is movable between a stowed position and a deployed position. The turbine encloses a governor assembly within a turbine hub. A rotating housing portion is connected to the turbine hub and a non-rotating housing is connected to the support structure. A lock plunger is used to prevent the turbine from rotating when in the stowed position.

The governor components are configured to have a certain amount of axial free play when in the deployed position. The governor components are preloaded in a start position by a relatively low force start spring, i.e. a 50 pound preload, for example. However, when in the stowed position, vibrations can overcome the start spring preload which can cause the components to hammer axially inside the turbine as a result of the axial free play. Engine wind milling vibrations, high level short duration (HLSD) vibrations, or random vibrations can cause this hammering effect. During an aircraft engine blade loss event, severe HLSD vibrations occur first as the engine spools down. Then, as the engine continues to turn due to air loads, a high unbalance load continues to drive longer duration wind milling vibrations. Either or both of these vibrations could significantly reduce the fatigue life of ram air turbine components.

As known, wind milling is generally unpowered aircraft engine rotation that occurs at frequencies below most ram air turbine resonant frequencies. However, HLSD vibrations are high level resonant vibrations where one or more ram air turbine modes are excited to resonance as the engine spools down resulting in high loads through the ram air turbine housings. As the aircraft engine speed decreases, the excitation frequency experienced by the ram air turbine sweeps from high to low frequencies, passing through normal ram air turbine frequencies during the decrease. Thus, these types of vibrations cause a hammering effect that can result in damaging impact loads.

SUMMARY OF THE INVENTION

In one exemplary embodiment, a governor assembly comprises a governor shaft rotatable about an axis, a stop shaft coupled for rotation with the governor shaft, a rotatable housing portion surrounding at least a portion of the stop shaft, and a lock plunger that is configured to extend through an opening in the rotatable housing.

In a further embodiment of the above, the stop shaft includes an enlarged shoulder portion that provides an abutment surface for the lock plunger to reduce axial movement of the governor shaft when stowed.

In a further embodiment of any of the above, the lock plunger is selectively movable between a locked position when the turbine assembly is in a stowed position and an unlocked position when the turbine assembly is in a deployed position.

In a further embodiment of any of the above, the governor shaft has a first amount of axial play when in a deployed position and wherein the lock plunger engages the stop shaft to provide a second amount of axial play for the governor shaft when in the stowed position, with the second amount of axial play being less than the first amount of axial play.

In a further embodiment of any of the above, the lock plunger extends through the opening in the rotatable housing portion when in the locked position which prevents the rotatable housing portion from rotating when stowed.

In a further embodiment of any of the above, one end of the stop shaft is coupled to one end of the governor shaft in a slip fit.

In another exemplary embodiment, a ram air turbine assembly comprises a turbine including a turbine hub and a plurality of turbine blades extending outwardly from the turbine hub, and includes a support structure supporting the turbine wherein the support structure is movable between a stowed position and a deployed position. A governor shaft is positioned within the turbine hub and defines an axis of rotation. A stop shaft is coupled for rotation with the governor shaft and a rotatable housing portion surrounds at least a portion of the stop shaft. A lock plunger is configured to extend through an opening in the rotatable housing portion to prevent rotation of the rotatable housing portion when in the stowed position In another exemplary embodiment, a lock plunger for a ram air turbine assembly comprises an elongated body extending from a first end to a second end with a shoulder portion positioned between the first and second ends. The first end is defined by a first dimension and the shoulder portion is defined by a shoulder diameter that is greater than the first dimension. A first axial length is defined from the first end to the shoulder portion. The first end includes flats that are defined by a second axial length that is less than the first axial length, and wherein a ratio of the second axial length to the first axial length is approximately 0.255.

An exemplary method of assembling a ram air turbine comprises supporting a lock plunger within a non-rotating housing portion; mounting a rotatable housing portion for rotation relative to the non-rotating housing portion, the rotatable housing portion surrounding at least a portion of a governor shaft coupled for rotation with a stop shaft; and selectively inserting a lock plunger through an opening in the rotatable housing portion such that the ram air turbine can be moved to a stowed position.

These and other features of this application will be best understood from the following specification and drawings, the following of which is a brief description.

DETAILED DESCRIPTION

Figure 1:
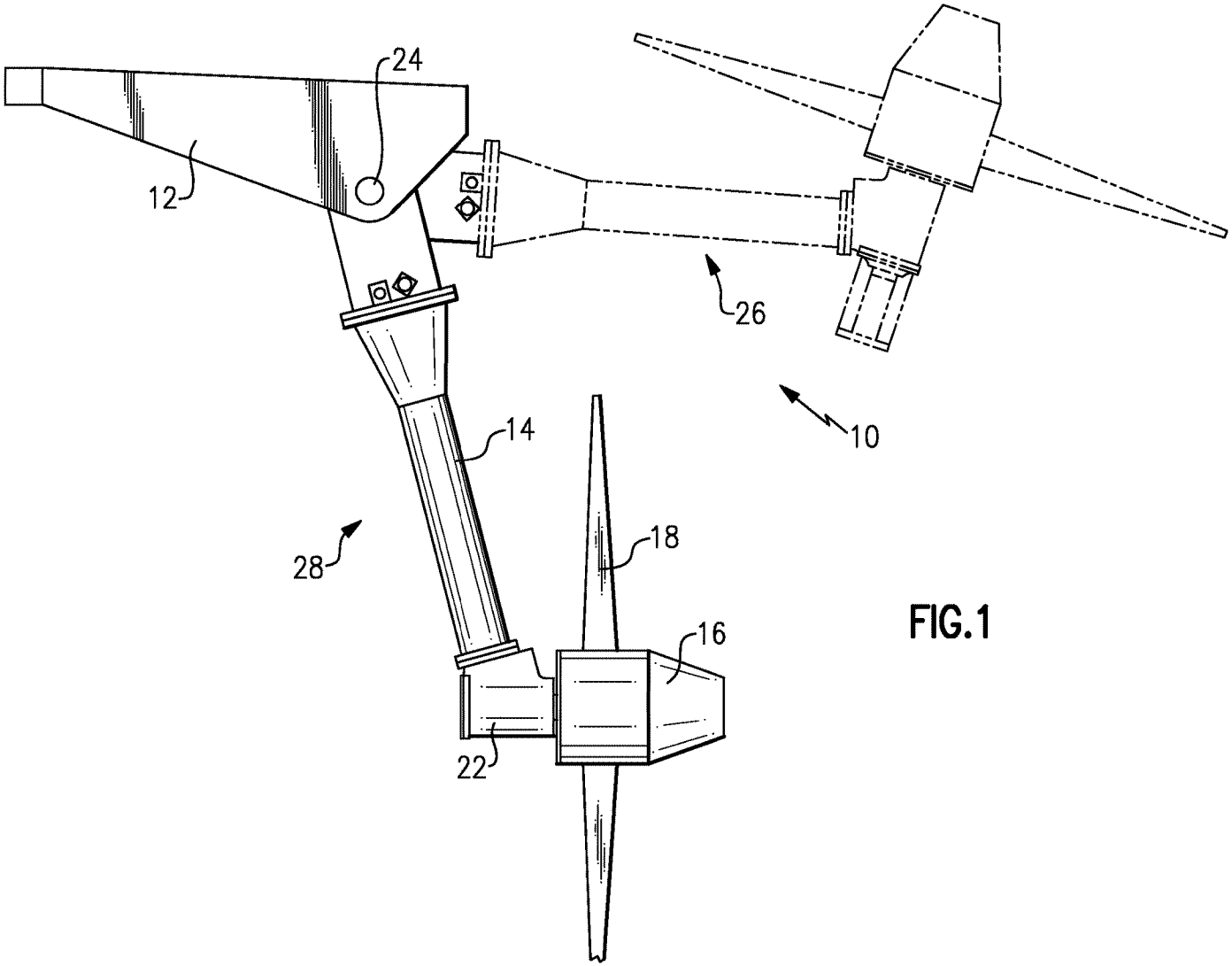
FIG. 1 schematically illustrates a ram air turbine assembly as movable between deployed and stowed positions.

FIG. 1 schematically illustrates a ram air turbine assembly 10 that includes a deployable support structure 14 pivotally attached to an aircraft structure 12. A rotating turbine hub 16 includes turbine blades 18 and is supported on a distal end of the support structure 14. The rotating hub 16 is supported on a housing 22 attached to the end of the support structure 14. The support structure 14 is movable about a pivot 24 between a stowed position 26 and a deployed position 28.

The example ram air turbine assembly 10 is shown and described by way of example, and other configurations and structures are within the contemplation of this invention. For example, U.S. patent application Ser. No. 13/430,890, filed on Mar. 27, 2012, assigned to the same assignee as the present application and herein incorporated by reference, shows another example of a ram air turbine arrangement.

Further, the example ram air turbine assembly 10 operates to provide auxiliary power generation in the event that a primary power generating unit aboard an aircraft is not working as desired. In such a circumstance, the example ram air power generating assembly 10 is moved from the stowed position 26 to the deployed position 28 and the turbine blades 18 rotate responsive to the airflow. The rotating turbine blades 18 and hub 16 drive through mechanisms such as a mechanical transmission or hydraulic circuit, a generator, and/or a pump to provide electrical or hydraulic power.

Figure 2:
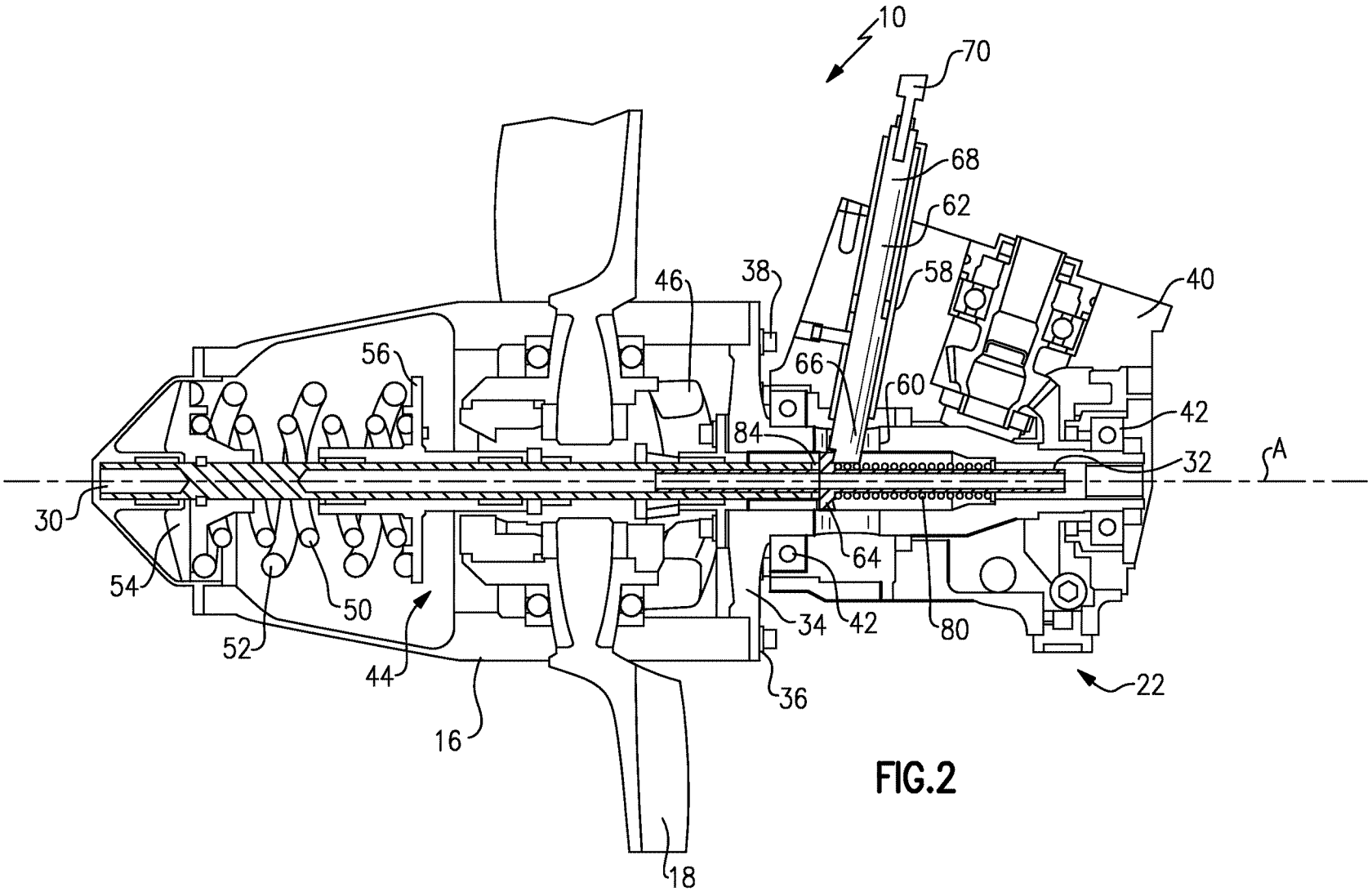
FIG. 2 is a cross-sectional side view of a ram air turbine assembly with a lock plunger in the locked or stowed position.

As shown in FIG. 2, the ram air turbine assembly 10 further includes a governor shaft 30 that is rotatable about an axis A and a stop shaft 32 coupled for rotation with the governor shaft 30. One end of the stop shaft 32 is received within one end of the governor shaft 30 in a slip fit arrangement. In the example shown, the end of the stop shaft 32 is slip fit into a bore in one end of the governor shaft 30; however, the reverse configuration could also be used. The governor 30 and stop 32 shafts are configured such that they rotate together about the axis A.

The housing 22 includes a rotatable housing portion 34 that surrounds at least a portion of the governor shaft 30 and the stop shaft 32. The rotatable housing portion 34 includes a flange portion 36 that is fixed to the rotating hub 16 with a plurality of fasteners 38. The housing 22 includes a non-rotating housing portion 40 that is secured to the support structure 14. The rotatable housing portion 34 is supported for rotation relative to the non-rotating housing portion 40 by one or more bearings 42.

As the governor shaft 30 rotates about the axis A, the shaft 30 rotates the hub 16 attached thereto. As known, a rotor flyweight assembly 44 is associated with the rotor blade 18 and includes at least one flyweight 46. A resilient member controls the position of the rotor blades 18, and in one example, comprises a coaxial spring set with an inner spring 50 and an outer spring 52 retained by a stationary outer spring seat 54 and a movable inner yoke plate 56 that slides on the governor shaft 30 to counteract the action of the flyweights 46.

The governor components are preloaded in a start position by a relatively low force start spring 80, i.e. a 50 pound preload, for example. However, when in the stowed position, vibrations can overcome the start spring preload which can cause the components (such as the governor shaft 30, springs 50, 52, yoke plate 56, and flyweights 46) to hammer axially inside the turbine as a result of the axial free play.

The flyweights 46 and springs 50, 52 are positioned within a cavity formed within the hub 16 and the cavity is closed off by the rotatable housing portion 34 when the flange portion 36 is secured to the hub 16. The non-rotating housing portion 40 surrounds the rotatable housing 34 and includes a passage 58 that extends in an outward direction away from the axis A. In one example, the passage 58 extends generally in a radial direction away from the axis A; however, the angle of the passage 58 relative to the axis A could be varied as needed. The rotatable housing portion 34 comprises a cylindrical member with a bore that surrounds at least portions of the governor 30 and stop 32 shafts. The rotatable housing portion 34 includes one or more openings 60 that are generally aligned with the passage 58 in the non-rotating housing portion 40.

A lock plunger 62 extends through the passage 58 and through the opening 60 in the rotatable housing portion 34 to selectively engage the stop shaft 32. The lock plunger 62 is used to prevent housing portion 34 from rotating by contact with opening 60 when in the stowed position.

The stop shaft 32 includes an enlarged shoulder portion 64 that provides an abutment surface for the lock plunger 62. The lock plunger 62 comprises an elongated body having a first end 66 that is associated with the stop shaft 32 and a second end 68 that is associated with a release cable 70. The lock plunger 62 is selectively moved by the release cable 70 between a locked position (first end 66 received within opening 60 and engaged with the stop shaft 32) when the turbine assembly 10 is in the stowed position 26 and an unlocked position (first end 66 pulled out of opening 60 and disengaged from the stop shaft 32 and housing 34) when the turbine assembly 10 is in the deployed position 28.

Figure 6:
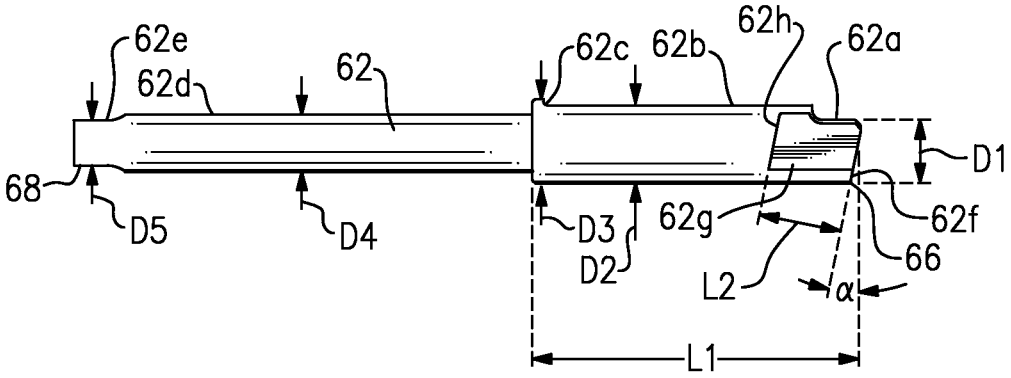
FIG. 6 is a top view of the lock plunger from FIG. 2.

As shown in FIG. 6, the lock plunger 62 extends from the first end 66 to the second end 68. At the first end, the lock plunger 62 includes a first portion 62*a* defined by a first dimension D1 that transitions into a second portion 62*b* defined by a diameter D2 that is greater than dimension D1. A surface at portion 62*a* comprises a radius that is configured to contact a conical surface formed at a location between the plunger 62 and the shoulder 64 in a generally conformal manner. As such, in this example, the dimension D1 does not comprise a true diameter. The lock plunger 62 includes a third portion 62*c*, comprising a shoulder that is defined by a third diameter D3, which is greater than the second diameter D2. The shoulder portion at D3 defines a maximum outer diameter of the lock plunger 62. Radially outward of the shoulder is a fourth portion 62*d* that is defined by a fourth diameter D4 that is less than the third diameter D3. The fourth portion 62*d* transitions into a fifth portion 62*e* defined by a fifth diameter D5, which is less than the fourth diameter. The fifth portion 62*e* includes flats for torque reaction when installing the release cable 70. Release cable 70 is threaded into plunger 62 using internal threads.

An end face 62*f* at the first end 66 is orientated at a slight angle $\alpha$ relative to the axis A. Further, the first end 66 includes flats 62*g* that extend along the first portion 62*a* and into the second portion 62*b*. The flats 62*g* terminate at an end face 62*h* that is generally parallel to the end face 62*f*. The axial length that extends from an end of the first portion 62*a* to the radially outermost end of the third portion 62*c* is defined by a first length L1. An axial length of the flats 62*g* from the end face 62*f* to the end face 62*h* is defined by a second length L2 that is less than the first length L1. An exemplary ratio of L2/L1 is approximately 0.255. In one example, L1 is approximately 2.721 inches (6.911 centimeters) and L2 is approximately 0.695 inches (1.765 centimeters).

The spring 80 is configured to bias the stop shaft 32 into close proximity to the lock plunger 62 when in the stowed position. A shimming operation is performed to provide a small gap between these components. This gap facilitates insertion of the plunger through the opening 60. The end 66 of the lock plunger being located within the opening 60 prevents the housing 34 from rotating.

Figure 3:
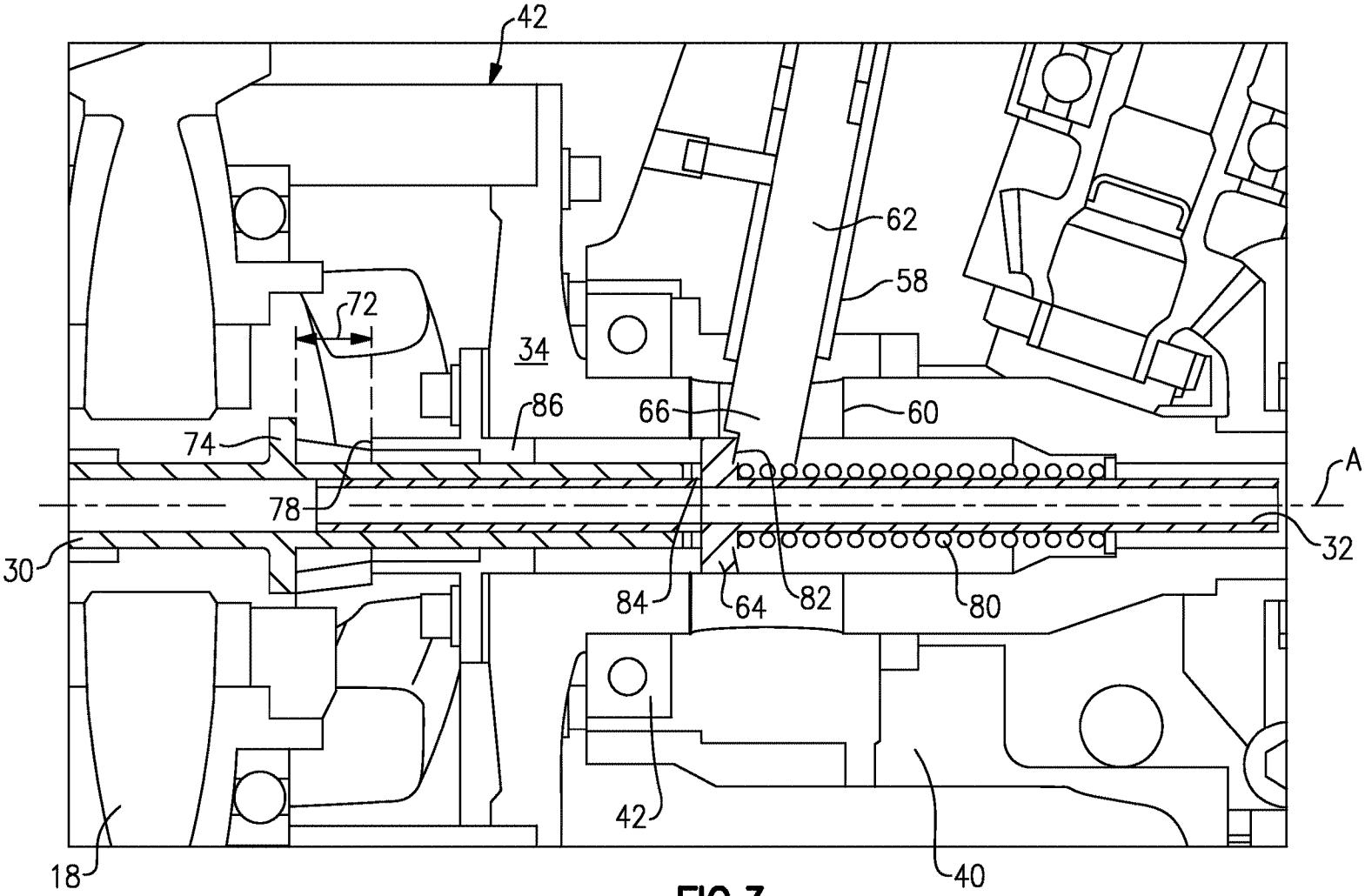
FIG. 3 is an enlarged view of a portion of FIG. 2 that includes the lock plunger.
Figure 4:
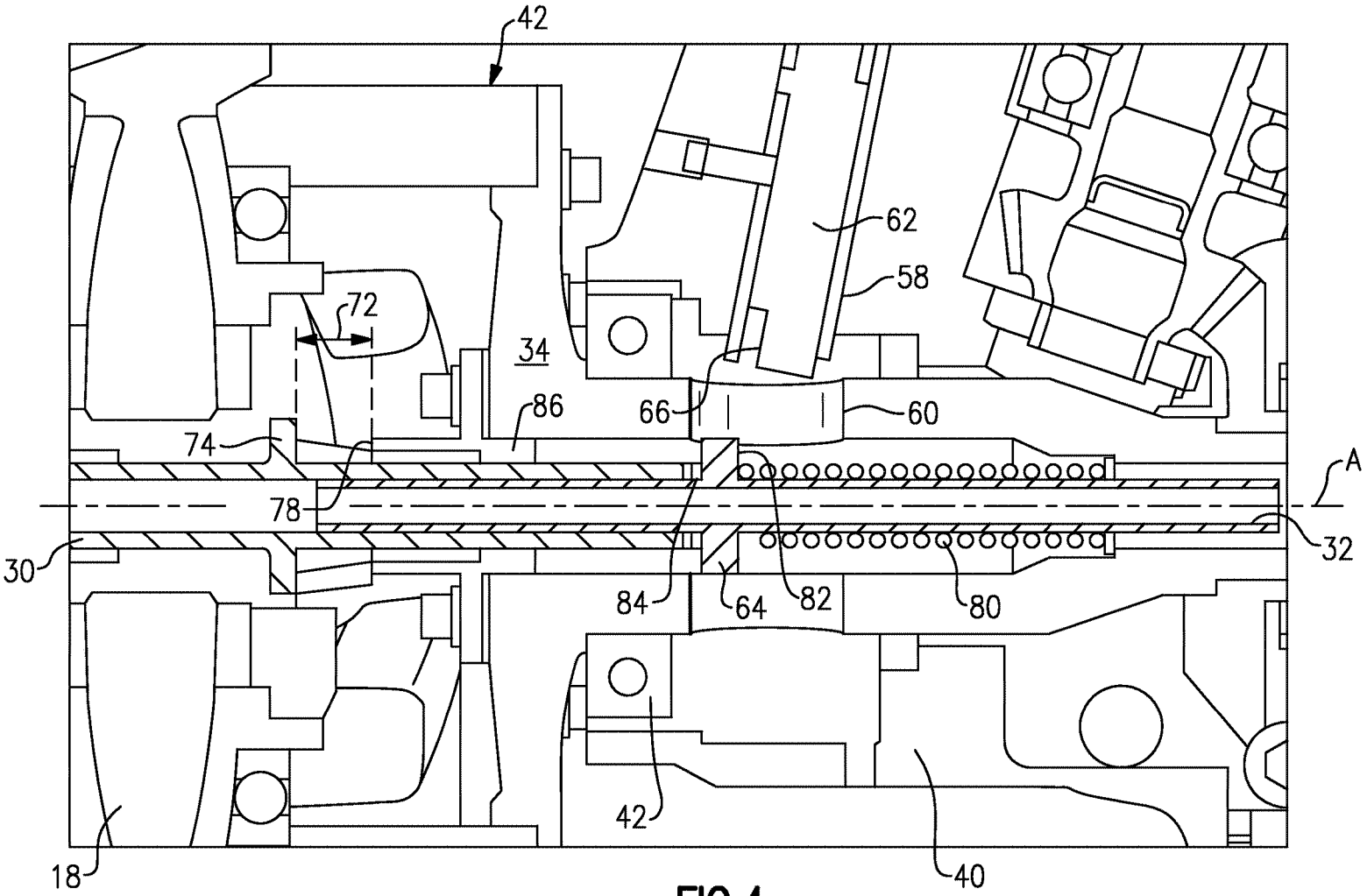
FIG. 4 is similar to FIG. 3 but shows the lock plunger in an unlocked or deployed position.

As shown in FIG. 4, the governor shaft 30 has a first amount of axial play 72 when in a deployed position. The lock plunger 62 engages the stop shaft 32 to reduce the amount of axial play for the governor shaft 30 when in the stowed position as shown in FIG. 3. As discussed above, the governor shaft 30 is free to slide axially within the hub 16 by a certain amount. The amount of sliding movement is defined between a shoulder 74 on the governor shaft 30 and an end face 78 of a support plate 86 that is associated with the rotatable housing portion 34. The first amount of axial play 72 can be as high as about 0.573 inches (about 1.455 centimeters), for example. However, when the lock plunger 62 is deployed or locked, as shown in FIG. 3, the governor shaft 30 is prevented from moving throughout this axial play range by engagement of the plunger 62 with the shoulder 64 of the stop shaft 32. Only a very small gap, i.e. approximately about 0.010 inches (about 0.025 centimeters) of axial play for example, remains as indicated at 82 between the plunger 62 and the shoulder 64. Shims 84 can also be used between an end of the governor shaft 30 and the shoulder 64 on the opposite side from the plunger 62 to create the desired gap.

Also, while the flyweights 46 do not slide axially within the hub 16, the flyweights 46 can pivot, when in the stowed position. This pivoting movement can also increase the hammering effect. Locking the governor shaft 30 with the plunger 62 prevents the flyweights 46 from pivoting when stowed, which further reduces the hammering effect.

Thus, the lock plunger 62 prevents axial and/or pivoting movement of various turbine components during vibration modes when the turbine is in the stowed position. Using the plunger 62 as an axial stop can drastically reduce axial free play by a significant percentage, which drastically reduces impact loads during axial vibration modes when stowed.

Figure 5:
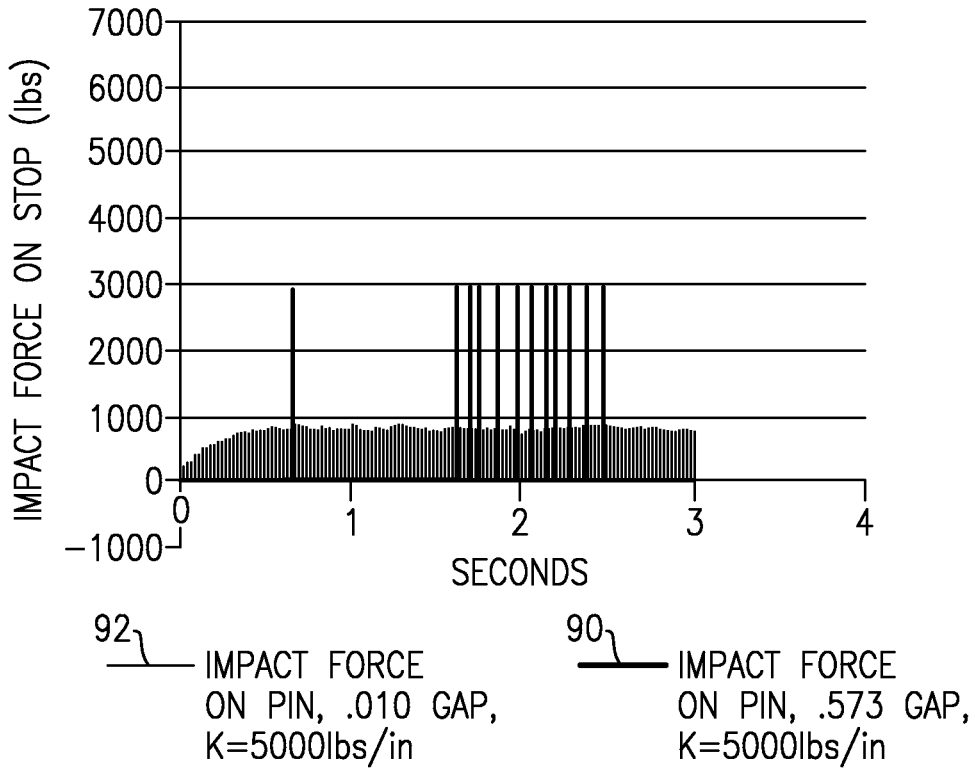
FIG. 5 is a graph showing an impact force on a stop that engages the plunger over time.

FIG. 5 is a graph showing a predicted reduction of impact loads due to the introduction of the axial constraint. Each example uses an effective lock plunger stiffness of 5000 pounds per inch (352 kilograms per centimeter). The first set of wide lines 90 shows an example of an impact force on a pin with about a 0.573 inch (about 1.455 centimeters) gap. The resulting impact force on the stop in this example is 3000 pounds (13345 N). The second set of narrow lines 92 shows an example of an impact force on a pin with about a 0.010 inch (about 0.025 centimeters) gap. The resulting impact force on the stop in this example is less than 1000 pounds (4448 N).

After deployment the increased amount of axial play 72 is needed for turbine operating purposes. However, as discussed above, this amount of axial play 72 is disadvantageous when the turbine is stowed due to the hammering effects that can result. The actuator moves the plunger to the locked position when the turbine is to be stowed. Movement of the plunger into engagement with the shaft assembly 30, 32 significantly reduces the axial play from an amount as indicated at 72 to an amount as indicated at 82, thereby reducing the amount of hammering. When the turbine is to be deployed, the plunger 62 is easily pulled out of engagement with the shaft assembly 30, 32, which allows the turbine to rotate and additionally returns the amount of axial play back to the initial increased amount as indicated at 72.

An example method of assembling a ram air turbine 10 comprises the steps of supporting the lock plunger 62 within the non-rotating housing portion 40, mounting the rotatable housing portion 34 for rotation relative to the non-rotating housing portion 40, and selectively inserting the lock plunger 62 through an opening 60 in the rotatable housing portion 34 to engage the stop shaft 32 such that the ram air turbine 10 can be moved to a stowed position.

Additional steps include arranging the governor shaft 30 and stop shaft 32 in a slip fit arrangement, forming an enlarged shoulder portion 64 on the stop shaft 32, and engaging the lock plunger 62 against an abutment surface on the enlarged shoulder portion 64 when in the stowed position.

Further, the lock plunger can be easily replaced during a service operation as needed. The method steps would include removing the lock plunger from the non-rotating housing portion 40 during the service operation, and inserting a new lock plunger 62 into the non-rotating housing portion 40 to replace the removed lock plunger.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A governor assembly comprising:

a governor shaft rotatable about an axis;

a stop shaft coupled for rotation with the governor shaft, and wherein the stop shaft includes an enlarged shoulder portion;

a rotatable housing portion surrounding at least a portion of the stop shaft;

a non-rotating housing portion supported for rotation relative to the rotatable housing portion by at least one bearing positioned radially inward of the non-rotating housing portion and radially outward of the rotatable housing portion; and a lock plunger that is configured to extend through an opening in the rotatable housing to engage the enlarged shoulder portion when in a stowed position, and wherein the non-rotating housing portion includes a passage through which the lock plunger extends.

2. The governor assembly according to claim 1, wherein the lock plunger is selectively movable between a locked position when the turbine assembly is in the stowed position and an unlocked position when the turbine assembly is in a deployed position, and wherein the enlarged shoulder portion provides an abutment surface for the lock plunger to reduce axial movement of the governor shaft when stowed.

3. The governor assembly according to claim 2, including at least one resilient member associated with the stop shaft to provide a preload start position for the governor assembly, and wherein the resilient member biases the stop shaft toward the lock plunger when in the stowed position.

4. The governor assembly according to claim 2, wherein the lock plunger extends through the opening in the rotatable housing portion when in the locked position which prevents the rotatable housing portion from rotating when stowed.

5. The governor assembly according to claim 2, wherein the governor shaft has a first amount of axial play when in a deployed position and wherein the lock plunger engages the stop shaft to provide a second amount of axial play for the governor shaft when in the stowed position, the second amount of axial play being less than the first amount of axial play.

6. The governor assembly according to claim 1, wherein one end of the stop shaft is coupled to one end of the governor shaft in a slip fit.

7. A governor assembly comprising:

a governor shaft rotatable about an axis;

a stop shaft coupled for rotation with the governor shaft;

a rotatable housing portion surrounding at least a portion of the stop shaft; and a lock plunger that is configured to extend through an opening in the rotatable housing, and wherein the lock plunger extends from a first end positioned near the stop shaft to a second end that is configured for connection to a release cable, and wherein the lock plunger includes a shoulder portion positioned between the first and second ends, and wherein the first end is defined by a first dimension and the shoulder portion is defined by a shoulder diameter that is greater than the first dimension, and wherein a first axial length is defined from the first end to the shoulder portion, and wherein the first end includes flats that are defined by a second axial length that is less than the first axial length, and wherein a ratio of the second axial length to the first axial length is approximately 0.255.

8. A ram air turbine assembly comprising:

a turbine including a turbine hub and a plurality of turbine blades extending outwardly from the turbine hub;

a support structure supporting the turbine wherein the support structure is movable between a stowed position and a deployed position;

a governor shaft positioned within the turbine hub and defining an axis of rotation;

a stop shaft coupled for rotation with the governor shaft, and wherein the stop shaft includes an enlarged shoulder portion;

a rotatable housing portion surrounding at least a portion of the stop shaft;

a non-rotating housing portion supported for rotation relative to the rotatable housing-portion by at least one bearing positioned radially inward of the non-rotating housing portion and radially outward of the rotatable housing portion; and a lock plunger that is configured to extend through an opening in the rotatable housing portion and engage the shoulder portion to prevent rotation of the rotatable housing portion when in the stowed position, and wherein the non-rotating housing portion is mounted to the support structure and includes a passage through which the lock plunger extends.

9. The ram air turbine assembly according to claim 8, wherein the enlarged shoulder portion provides an abutment surface for the lock plunger to reduce axial movement of the governor shaft when in the stowed position.

10. The ram air turbine assembly according to claim 8, wherein the governor shaft has a first amount of axial play when in the deployed position and wherein the lock plunger engages the stop shaft to provide a second amount of axial play for the governor shaft when in the stowed position, the second amount of axial play being less than the first amount of axial play.

11. The ram air turbine assembly according to claim 8, wherein one end of the stop shaft is coupled to one end of the governor shaft in a slip fit, and including at least one resilient member engaging the stop shaft to provide a preload start position for the governor assembly, and wherein the resilient member biases the stop shaft toward the lock plunger when in the stowed position.

12. A lock plunger for a ram air turbine assembly comprising:

an elongated body extending from a first end to a second end; and wherein the lock plunger includes a shoulder portion positioned between the first and second ends, and wherein the first end is defined by a first dimension and the shoulder portion is defined by a shoulder diameter that is greater than the first dimension, and wherein a first axial length is defined from the first end to the shoulder portion, and wherein the first end includes flats that are defined by a second axial length that is less than the first axial length, and wherein a ratio of the second axial length to the first axial length is approximately 0.255.

13. The lock plunger according to claim 12, wherein the first end is configured to be positioned near a ram air turbine stop shaft and the second end is configured for connection to a release cable.

14. A method of assembling a ram air turbine comprising:

supporting a lock plunger within a non-rotating housing portion;

mounting a rotatable housing portion for rotation relative to the non-rotating housing portion, the rotatable housing portion surrounding at least a portion of a governor shaft coupled for rotation with a stop shaft that includes an enlarged shoulder portion;

mounting the non-rotating housing portion for rotation relative to the rotatable housing portion by at least one bearing positioned radially inward of the non-rotating housing portion and radially outward of the rotatable housing portion; and selectively inserting a lock plunger through an opening in the rotatable housing portion to engage the shoulder portion to prevent rotation of the rotatable housing portion when in a stowed position.

15. The method according to claim 14, further comprising:

arranging the governor shaft and stop shaft in a slip fit arrangement;

engaging a start spring against the enlarged shoulder portion on the stop shaft to bias the stop shaft toward the lock plunger when in the stowed position; and engaging the lock plunger against an abutment surface on the enlarged shoulder portion to reduce axial movement of the governor shaft when in the stowed position.

16. The method according to claim 14, further comprising:

removing the lock plunger from the non-rotating housing portion during a service operation; and inserting a new lock plunger into the non-rotating housing portion to replace the removed lock plunger.

17. A method of assembling a ram air turbine comprising:

supporting a lock plunger within a non-rotating housing portion;

mounting a rotatable housing portion for rotation relative to the non-rotating housing portion, the rotatable housing portion surrounding at least a portion of a governor shaft coupled for rotation with a stop shaft;

selectively inserting a lock plunger through an opening in the rotatable housing portion, such that the ram air turbine can be moved to a stowed position; and forming the lock plunger to extend from a first end positioned near the stop shaft to a second end that is configured for connection to a release cable, and wherein the lock plunger includes a shoulder portion positioned between the first and second ends, and wherein the first end is defined by a first dimension and the shoulder portion is defined by a shoulder diameter that is greater than the first dimension, and wherein a first axial length is defined from the first end to the shoulder portion, and wherein the first end includes flats that are defined by a second axial length that is less than the first axial length, and wherein a ratio of the second axial length to the first axial length is approximately 0.255.

18. A ram air turbine assembly comprising:

a turbine including a turbine hub and a plurality of turbine blades extending outwardly from the turbine hub;

a support structure supporting the turbine wherein the support structure is movable between a stowed position and a deployed position;

a governor shaft positioned within the turbine hub and defining an axis of rotation;

a stop shaft coupled for rotation with the governor shaft;

a rotatable housing portion surrounding at least a portion of the stop shaft; and a lock plunger that is configured to extend through an opening in the rotatable housing portion to prevent rotation of the rotatable housing portion when in the stowed position, and wherein the lock plunger extends from a first end positioned near the stop shaft to a second end that is configured for connection to a release cable, and wherein the lock plunger includes a shoulder portion positioned between the first and second ends, and wherein the first end is defined by a first dimension and the shoulder portion is defined by a shoulder diameter that is greater than the first dimension, and wherein a first axial length is defined from the first end to the shoulder portion, and wherein the first end includes flats that are defined by a second axial length that is less than the first axial length, and wherein a ratio of the second axial length to the first axial length is approximately 0.255.

* * * * *